US011103756B2

(12) United States Patent
Lim

(10) Patent No.: US 11,103,756 B2
(45) Date of Patent: Aug. 31, 2021

(54) BALL SUPPLY DEVICE

(71) Applicant: Wagolf Ltd., Incheon (KR)

(72) Inventor: Young Soo Lim, Seoul (KR)

(73) Assignee: Wagolf Ltd., Incheon (KR)

( * ) Notice: Subject to any disclaimer, the term of this patent is extended or adjusted under 35 U.S.C. 154(b) by 0 days.

(21) Appl. No.: 16/830,303

(22) Filed: Mar. 26, 2020

(65) Prior Publication Data

US 2020/0306601 A1 Oct. 1, 2020

(30) Foreign Application Priority Data

Mar. 28, 2019 (KR) ..... 10-2019-0035912

(51) Int. Cl.
*A63B 57/00* (2015.01)

(52) U.S. Cl.
CPC ..... *A63B 57/0006* (2013.01)

(58) Field of Classification Search
CPC ..... A63B 57/0006; A63B 2047/004
See application file for complete search history.

(56) References Cited

U.S. PATENT DOCUMENTS 3,003,770 A * 10/1961 Jones ..... A63B 57/0006 473/134
3,738,662 A * 6/1973 Hodgin ..... A63B 57/0006 473/133
4,265,453 A * 5/1981 Loot ..... A63B 57/0006 473/134
4,602,789 A * 7/1986 Chung ..... A63B 57/0006 124/50
4,995,614 A * 2/1991 Tange ..... A63B 47/002 473/137
5,346,222 A * 9/1994 Luther, Sr. ..... A63B 57/0006 473/137
5,464,223 A * 11/1995 Dermott ..... A63B 47/002 473/134
5,624,325 A * 4/1997 Smith ..... A63B 57/0006 473/133
5,820,475 A * 10/1998 Luna ..... A63B 57/0006 473/137
6,174,243 B1 * 1/2001 Choi ..... A63B 57/0006 473/134
6,419,589 B1 * 7/2002 Carter ..... A63B 57/0006 221/277

(Continued)

FOREIGN PATENT DOCUMENTS

KR 10-1996-33495 A 10/1996
KR 20-0448988 Y1 6/2010
KR 10-1275349 B1 6/2013

*Primary Examiner* — Steven B Wong
(74) *Attorney, Agent, or Firm* — Revolution IP, PLLC

(57) ABSTRACT

A ball supply device includes rubber tee on which golf ball is safely mounted; a main body which is spaced apart from the rubber tee; a loading movement plate that is provided in an upper portion of the main body to partially seal the upper portion of the main body; a safe mounting guide portion that rotates on the front side of the main body and guides the golf balls released to the release hole to the rubber tee; a ball hitting portion that is rotatably provided on the front side of the main body to be rotated by the golf ball supplied to the safe mounting guide portion; a ball sensing portion that has one end located on the lower portion of the rubber tee; and a protective cover portion that surrounds the ball sensing portion.

10 Claims, 7 Drawing Sheets

(56) References Cited

U.S. PATENT DOCUMENTS

| | | | | |
|---|---|---|---|---|
| 7,059,969 | B2 * | 6/2006 | Howe | A63B 47/002 473/137 |
| 8,485,912 | B2 * | 7/2013 | Kim | A63B 57/0006 473/137 |
| 2003/0171158 | A1 | 9/2003 | Lee | |
| 2008/0125237 | A1 * | 5/2008 | Avery | A63B 69/3661 473/278 |

* cited by examiner

BALL SUPPLY DEVICE

CROSS-REFERENCE(S) TO RELATED APPLICATIONS

This application claims priority to Korean Patent Application No. 10-2019-0035912, filed on Mar. 28, 2019, the disclosure of which is incorporated herein by reference in its entirety.

BACKGROUND

The present invention relates to a ball supply device, and more particularly, to a ball supply device that automatically supplies a golf ball onto ae rubber tee in a case where the golf ball is hit in a state where golf ball is placed on the rubber tee.

BACKGROUND ART

In general, a golfer continuously performs a shot at a designated spot in a golf practice field or a screen golf course, and thus, a large number of golf balls are collected to be used. At this time, in a case where the ball needs to be hit after being placed on a tee, it is cumbersome and difficult for the golfer to bow and unfold in order to place the golf ball on the tee, and thus, a golf ball supply device that automatically supplies the golf ball onto the tee is used.

The golf ball supply device described above mostly supplies a golf ball by using a motor or other power, and an automatic golf ball distributer that uses power is disclosed in Korean Patent Publication No. 1996-33495 (Oct. 22, 1996).

However, since the automatic golf ball distributer includes a motor and an element organically connected to the motor, the automatic golf ball distributer is structurally complicated and consumes electric energy, and thus, there is a problem that causes noise at the time of driving.

SUMMARY OF INVENTION

Technical Problem

The present invention is made to solve the above-described problem, and an object thereof is to provide a ball supply device that automatically supplies a golf ball onto a rubber tee without means using electric energy in a case where a golf ball on the rubber tee is hit.

Solution to Problem

In order to achieve the above-described object, there is provided a ball supply device including rubber tee on which golf ball is safely mounted; a main body which is spaced apart from the rubber tee and in which a plurality of golf balls to be safely mounted on the rubber tee are contained and a supply guide rail for guiding movement of the golf balls are provided inside the main body in a multi-bent shape such that the plurality of contained golf balls are sequentially released to a release hole formed on a front side; a loading movement plate that is provided in an upper portion of the main body to partially seal the upper portion of the main body and has a shape inclined downwards such that the plurality of golf balls to be supplied to the upper portion are supplied to one side of the supply guide rail by gravity; a safe mounting guide portion that rotates on the front side of the main body and guides the golf balls released to the release hole to the rubber tee so as to be safely mounted on the rubber tee; a ball hitting portion that is rotatably provided on the front side of the main body to be rotated by the golf ball supplied to the safe mounting guide portion, has one end connected to the safe mounting guide portion, and has the other end provided with a hitting protrusion for hitting a lower portion of the golf ball to move the stopped golf ball on the supply guide rail; a ball sensing portion that has one end located on the lower portion of the rubber tee, has the other end selectively coming into close contact with the hitting protrusion, and rotates the ball hitting portion and the safe mounting guide portion by selectively coming into close contact with the ball hitting portion while rotating depending on the presence or absence of the golf ball on the rubber tee; and a protective cover portion that surrounds the ball sensing portion so as not to be exposed to the outside and has a through-hole through which the rubber tee passes.

In the ball supply device according to the present invention, the main body may include a first main body having a box shape with an open upper portion, and a second main body that supports a lower portion of the first main body, an insertion groove may be formed on the front side of the first main body, and a rotation groove in which the ball hitting portion rotates may be formed on a front side of the second main body, and the safe mounting guide portion and the ball hitting portion may be located to be upright within the insertion groove and the rotation groove when coming into close contact with the front side of the main body.

The insertion groove may be formed by a first insertion bending end and a second insertion bending end spaced apart from the front side of the first main body, and an insertion connection end connecting the first insertion bending end and the second insertion bending end which are paced apart from each other, and the release hole through which the golf ball moved to the supply guide rail is released outside the main body may be formed in the insertion connection end.

The rotation groove may be connected to the insertion groove, the rotation groove may be formed by a first rotation bending end and a second rotation bending end which are spaced apart from the front side of the second main body, and a rotation connection end connecting the first rotation bending end and the second rotation bending end which are spaced apart from each other, and a first mounting hole and a second mounting hole in which the ball hitting portion is rotatably mounted may be formed in the first rotation bending end and the second rotation bending end.

An upper portion of the release hole of the first main body may be provided with a ball stopper member for blocking release of the golf ball to be released to the release hole through the supply guide rail and for releasing the blocking when the safe mounting guide portion comes into close contact with the insertion groove, and the ball stopper member may include a stopper body configured by an upper support and a lower catching stand which are spaced apart from each other in a vertical direction and are coupled to protrude to an inside of the main body, and a stopper catching plate that has an upper end to be rotatably hinged to the upper support and a lower end to span the lower catching stand.

The safe mounting guide portion may have a rod shape, a catching hitting stand for rotating the stopper catching plate when the safe mounting guide portion rotates is mounted on one surface thereof to protrude, and a passage hole through which the golf ball passes is formed in one end of the safe mounting guide portion so as to pass through the safe mounting guide portion.

The ball hitting portion may include a connection main body that has one end connected to the safe mounting guide portion and has a protruding hinge end hinged to the first and second rotation bending ends; a connection end that protrudes outwards from one end of the connection main body and is located at a lower portion of an end of the supply guide rail when the safe mounting guide portion rotates upwards; and a hitting protrusion that is provided at the other end of the connection body and hits a lower portion of a golf ball in a stopped state on the supply guide rail when the safe mounting guide portion rotates downwards.

A stop hole in which a golf ball is inserted and safely mounted to maintain a stop state before being released to the release hole may be formed on the supply guide rail, and the stop hole may be located adjacent to the release hole.

The supply guide rail may include a first guide rail that is provided on one side of the first main body to sequentially move downwards golf balls supplied from the loading movement plate; a second guide rail that is provided on a rear side of the first main body and is vertically connected to the first guide rail to sequentially move golf balls supplied through the first guide rail; a third guide rail that is provided on the other side of the first main body and is vertically connected to the second guide rail to move a golf ball supplied through the second guide rail; a fourth guide rail that is provided in one end on a front side of the first main body and is vertically connected to the third guide rail to move a golf ball supplied through the third guide rail; a fifth guide rail that is vertically connected to the fourth guide rail to move a golf ball supplied through the fourth guide rail to an inside of the first main body; a sixth guide rail that is vertically connected to the fifth guide rail to move a golf ball supplied through the fifth guide rail in a direction in which the first guide rail is located; and a seventh guide rail that is vertically connected to the sixth guide rail to move a golf ball supplied through the sixth guide rail to a release hole located on a front side of the first main body, and the stop hole may be located in a portion where the sixth guide rail and the seventh guide rail are connected.

The hitting protrusion may be provided with a close contact groove with which one end of the ball sensing portion is in close contact and a catching end on which the one end of the ball sensing portion is caught, and a catching protrusion that is in close contact with the close contact groove and is caught on the catching end may be provided in the other end of the ball sensing portion so as to protrude.

A mounting protrusion hinged to a hinge fastening groove of the protective cover portion may be provided in the ball sensing portion so as to protrude outwards, and the mounting protrusion may be located at a central portion of the ball sensing portion to be biased toward one end in close contact with the rubber tee.

The protective cover portion may include a supporting member that has a quadrangular shape with an open upper portion, may include a hinge fastening groove hinged to the mounting protrusion, and rotatably supports a lower portion of the ball sensing portion, and may include a sealing member which seals the open upper portion of the support member and in which a through-hole through which the rubber tee passes, and an end of the sealing member may be bent upwards and may be in close contact with the rotation groove.

Advantageous Effects

According to a ball supply device of the present invention, after the golf balls sequentially moved through the supply guide rail are detached from an upper portion of a stop hole by a ball hitting portion interlocking with an operation of a safe mounting guide portion in a state where the golf balls are safely mounted in the stop hole, the golf balls are safely mounted on the rubber tee through the safe mounting guide portion, and thus, elements that are organically connected to electric energy and a motor may be excluded, and while reducing failures, the golf balls are automatically and simply supplied onto the rubber tee without noise, resulting in reduction of a maintenance cost.

DETAILED DESCRIPTION OF THE EMBODIMENTS

Figure 1:
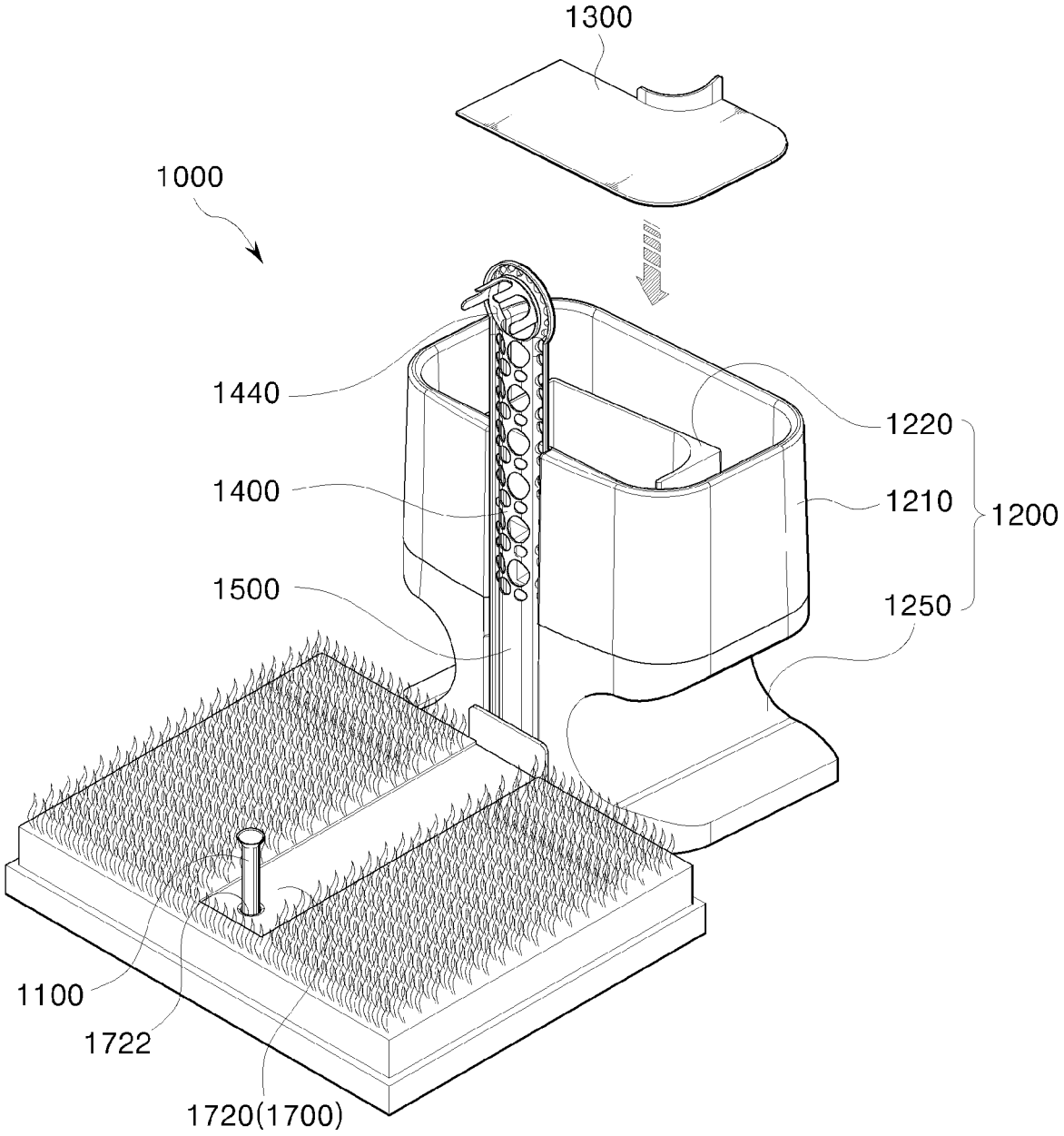
FIG. 1 is a perspective view schematically illustrating a configuration of a ball supply device according to an embodiment of the present invention.
Figure 2:
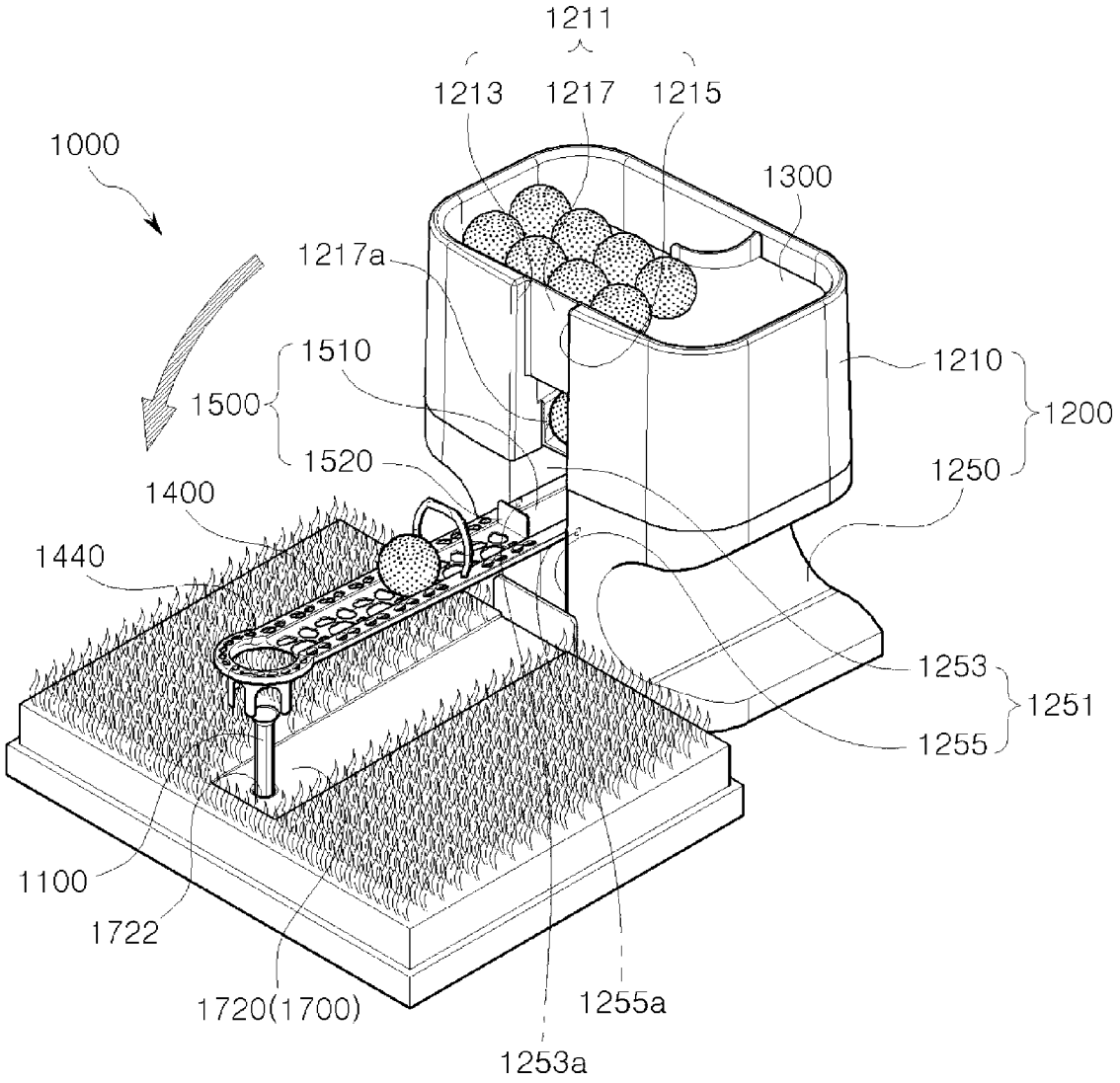
FIGS. 2 to 4 are views illustrating a state where a safe mounting guide portion and a ball hitting portion provided on a front side of a main body.
Figure 3:
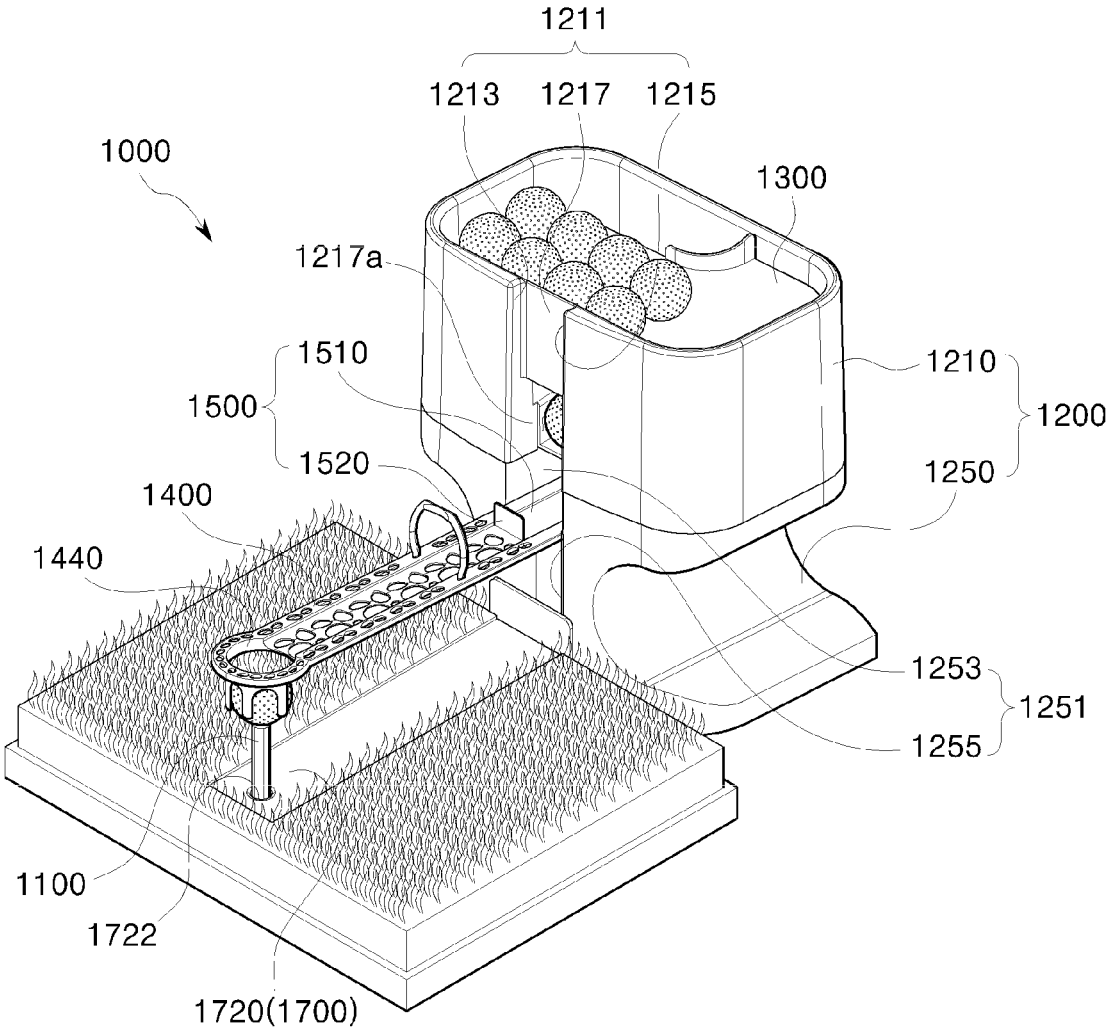
Figure 4:
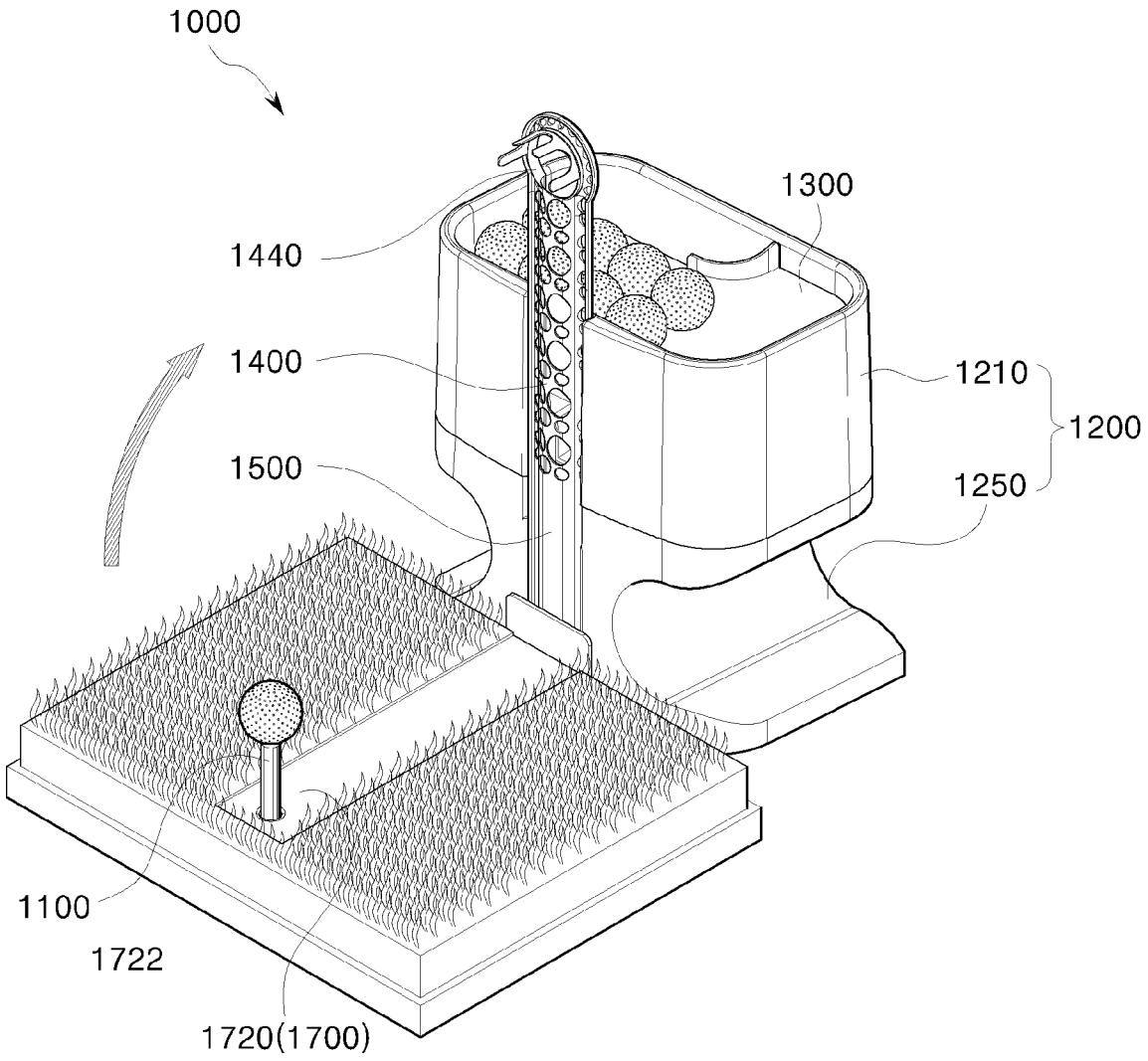

Hereinafter, preferred embodiments of the present invention will be described in detail with reference to the accompanying drawings. Prior to this, terms or words used in the present specification and claims should not be construed as being limited to ordinary or lexical meanings, and should be construed as meaning and concepts consistent with the technical idea of the present invention, based on the principle that the inventor may appropriately define concepts of the terms in order to best describe the invention.

Referring to the drawings, the ball supply device 1000 according to an embodiment of the present invention includes a rubber tee 1100, a main body 1200, a loading movement plate 1300, a safe mounting guide portion 1400, a ball hitting portion 1500, a ball sensing portion 1600, and a protective cover portion 1700.

In one embodiment of the present invention, it is described that, after a golf ball is safely mounted on the rubber tee 1100, the golf ball is automatically supplied to the rubber tee 1100 when a user hits the golf ball, but the golf ball is not limited to a golf ball, the present invention may be modified to automatically supply various balls, such as a baseball ball and a tee ball.

Referring to FIGS. 1 to 4, a golf ball supplied from the main body 1200 is safely mounted on an upper portion of the rubber tee 1100, and the rubber tee 1100 is slid to move up and down by a ball sensing portion 1600 to be described below. The rubber tee 1100 is general, and detailed description thereof will be omitted.

The main body 1200 is spaced apart from the rubber tee 1100, and a plurality of golf balls to be safely mounted on the rubber tee 1100 are contained in the main body 1200, and the supply guide rail 1220 for sequentially supplying the plurality of contained golf balls to a release hole 1217*a* formed on a front end surface of the main body 1200 is provided inside the main body 1200 in a multi-bent shape.

The main body 1200 includes a first main body 1210 and a second main body 1250. The first main body 1210 has a quadrangular shape with an open upper portion, and an insertion groove 1211 is formed on a front side of the first main body 1210.

The supply guide rail 1220 and a ball stopper member 1230 for blocking release of a golf ball to be released to the release hole 1217*a* are provided inside the first main body 1210.

The first main body 1210 is supported by the second main body 1250, a rotation groove 1251 connected to the insertion groove 1211 is formed on a front side of the second main body 1250, and the ball hitting portion 1500 which will be described below rotates in the rotation groove 1251.

The insertion groove 1211 is formed by a first insertion bending end 1213, a second insertion bending end 1215, and an insertion connection end 1217. The first insertion bending end 1213 and the second insertion bending end 1215 are provided on a front side of the first main body 1210 to be spaced apart from each other, and the first insertion bending end 1213 and the second insertion bending end 1215 are connected by the insertion connection end 1217. The release hole 1217*a* through which golf balls sequentially supplied through the supply guide rail 1220 are released to the outside of the first main body 1210 is formed in the insertion connection end 1217.

The loading movement plate 1300 is provided in an upper portion of the main body 1200 to partially seal an upper portion of the open first main body 1210, and a plurality of golf balls are supplied to an upper portion of the loading movement plate 1300. The loading movement plate 1300 has a shape inclined downwards in one direction, and is formed to be inclined downwards in one direction, and thus, a plurality of golf balls supplied upward are supplied by gravity to one side of the supply guide rail 1220 provided inside the first main body 1210.

Figure 7:
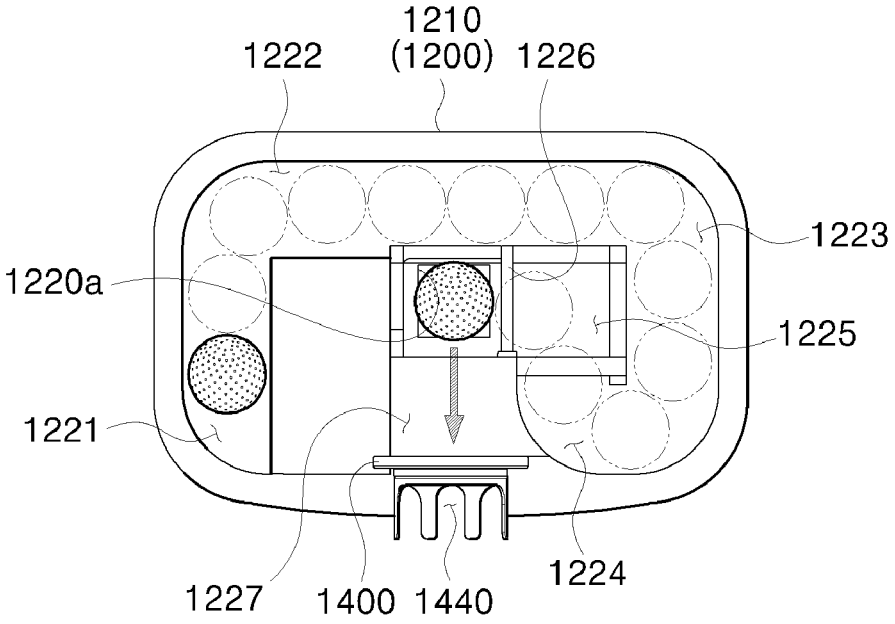
FIG. 7 is a view illustrating a supply guide rail provided inside a main body.

Referring to FIGS. 1 and 7, the supply guide rail 1220 includes a first guide rail 1221, a second guide rail 1222, a third guide rail 1223, a fourth guide rail 1224, a fifth guide rail 1225, a sixth guide rail 1226, and a seventh guide rail 1227.

It is preferable that the first guide rail 1221 is provided on one side of the first main body 1210 to sequentially move the golf balls supplied from the loading movement plate 1300, and the first guide rail 1221 is formed to be inclined downwards.

It is preferable that the first guide rail 1221 is vertically connected to the second guide rail 1222, the second guide rail 1222 is provided on a rear side of the first main body 1210, and the second guide rail (1222) also has a shape inclined downwards.

The second guide rail 1222 is vertically connected to the third guide rail 1223, the third guide rail 1223 is provided on the other side of the first main body 1210 to correspond to the first guide rail 1221, and the third guide rail 1223 also has a shape inclined downwards.

The third guide rail 1223 is vertically connected to the fourth guide rail 1224, and the fourth guide rail 1224 is provided at one end of the front side of the first main body 1210 to provide the third guide rail. The golf balls supplied through 1223 are sequentially moved and are inclined downwards.

The fourth guide rail 1224 is vertically connected to the fifth guide rail 1225, and the fifth guide rail 1225 moves the golf balls supplied through the fourth guide rail 1224 in an inner direction of the first main body 1210.

The fifth guide rail 1225 is vertically connected to the sixth guide rail 1226, and the sixth guide rail 1226 moves the golf balls supplied through the fifth guide rail 1225 in a direction at which the first guide rail 1221 is located.

The sixth guide rail 1226 is vertically connected to the seventh guide rail 1227, and the seventh guide rail 1227 serves to move the golf balls supplied through the sixth guide rail 1226 to the release hole 1217*a* located on the front side of the first main body 1210. It is preferable that a stop hole 1220*a* is formed at a portion where the sixth guide rail 1226 is connected to the seventh guide rail 1227, the stop hole 1220*a* maintains the golf ball, which is inserted and safely mounted in the stop hole, in a stopped state before the golf ball is released to the release hole 1217*a*, and the stop hole 1220*a* is located adjacent to the release hole 1217*a*.

Since the supply guide rail 1220 is bent in multiple stages, loads on the golf balls moving downwards through the supply guide rail 1220 are dispersed and reduced at a bending portion, and thus, the golf balls are sequentially supplied to the stop hole 1220*a* through the supply guide rail 1220 without clogging. As shown in FIG. 7, the length of the supply guide rail is sequentially reduced from the second guide rail to the sixth guide rail.

Figure 5:
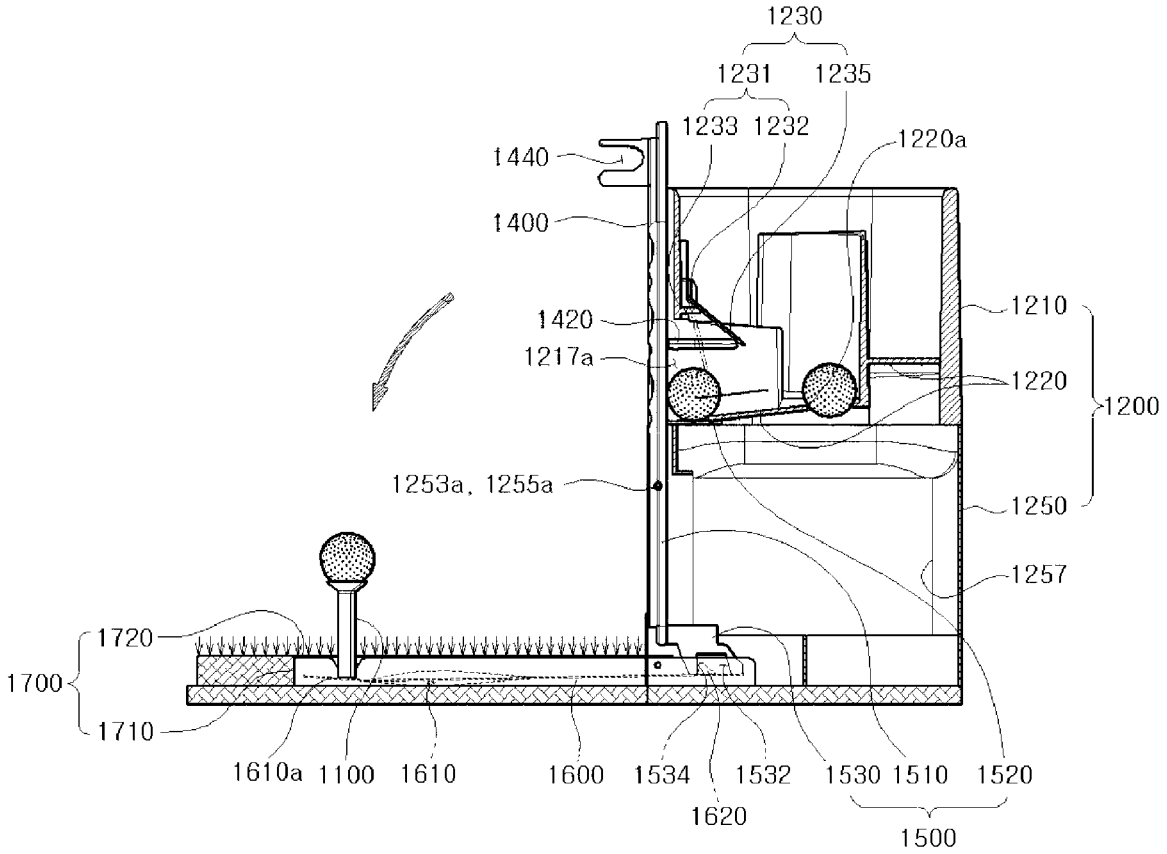
FIG. 5 is an operation cross-sectional view in a state where a golf ball is safely mounted on a rubber tee of a ball supply device according to an embodiment of the present invention.
Figure 6:
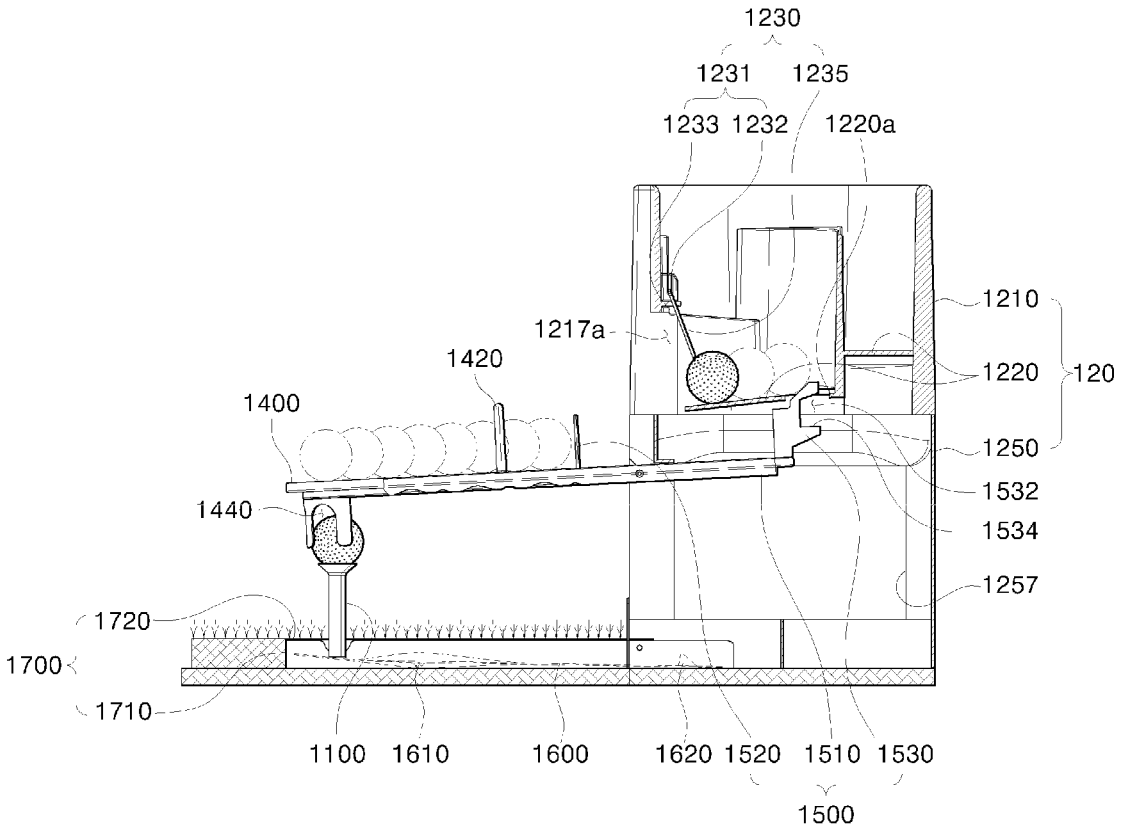
FIG. 6 is an operation cross-sectional view in a state where a golf ball is not mounted on a rubber tee of a ball supply device according to an embodiment of the present invention.

Referring to FIGS. 5 and 6, an upper portion of the release hole 1217*a* is provided with a ball stopper member 1230 that blocks release of the golf ball to be released to the release hole 1217*a* through the supply guide rail 1220 and releases the blocking when the safe mounting guide portion 1400 to be described comes into close contact with the insertion groove 1211.

The ball stopper member 1230 includes a stopper body 1231 and a stopper catching plate 1235. The stopper body 1231 includes an upper supporter 1232 and a lower supporter 1233 installed on an inner wall of the first main body 1210. The upper supporter 1232 and the lower supporter 1233 are coupled to the inner wall of the first main body 1210 at regular intervals in a vertical direction. The upper supporter 1232 rotatably supports an upper end of the stopper catching plate 1235, and the lower supporter 1233 supports a lower end of the stopper catching plate 1235 such that the upper supporter 1232 does not rotate further toward the release hole 1217*a*. The stopper catching plate 1235 is hinged rotatably to the upper support 1232 of the stopper body 1231 in a direction of the golf ball. As such, in a state where the upper end of the stopper catching plate 1235 is hinged rotatably to the upper supporter 1232, the lower end spans the lower supporter 1233.

As such, according to the ball stopper portion 1230, in a state where the golf ball that is detached from the stop hole 1220*a* and moves in a direction of the release hole 1217*a* is caught to be stopped by the stopper catching plate 1235, when one end of the safe mounting guide portion 1400 to be described below rotates upwards, the catching hitting stand 1420 to be described below collides with the stopper catching plate 1235 to push in a direction of the stop hole 1220*a* such that the golf ball is released from a stop state by the stopper catching plate 1235, and thus, the golf ball may move in a direction of the release hole 1217*a*.

Referring to FIGS. 1 to 4, the rotation groove 1251 formed on a front side of the second main body 1250 includes a first rotation bending end 1253, a second rotation bending end 1255, and a rotation connection end 1257. The first rotation bending end 1253 and the second rotation bending end 1255 are provided on the front side of the second main body 1250 to be spaced apart from each other and are bent to be inserted into an inside from a circumferential surface of one side, and the first rotation bending end 1253 and the second rotation bending end 1255 are connected by a rotation connection end 1257. It is preferable that a first mounting hole 1253*a* and a second mounting hole 1255*a* in which the ball hitting portion 1500 to be described below is rotatably mounted are formed in the first rotation bending end 1253 and the second rotation bending end 1255, respectively.

The safe mounting guide portion 1400 is rotatably provided on the front side of the first main body 1210, and the safe mounting guide portion 1400 serves to guide the released golf ball to the release hole 1217*a* to be safely mounted on the rubber tee 1100.

It is preferable that the safe mounting guide portion 1400 has a rod shape, and the catching hitting stand 1420 for rotating the stopper catching plate 1235 when the safe mounting guide portion 1400 rotates is mounted on one surface thereof to protrude therefrom, and a passage hole 1440 through which a golf ball to be guided passes is formed at one end of the safe mounting guide portion 1400 to pass through the safe mounting guide portion 1400.

The ball hitting portion 1500 is rotatably mounted on a front side of the second main body 1250. The ball hitting portion 1500 is connected to the safe mounting guide portion 1400 to be rotated by a golf ball supplied to the safe mounting guide portion 1400 through the release hole 1217*a*, one end thereof is connected to the safe mounting guide portion 1400 and the other end is provided with a hitting protrusion 1530 for hitting a lower portion of the golf ball safely mounted in the stop hole 1220*a* on the supply guide rail 1220.

Referring to FIGS. 5 and 6, the ball hitting portion 1500 includes a connection main body 1510, a connection end 1520, and the hitting protrusion 1530. It is preferable that the connection body 1510 has one end connected to the safe mounting guide portion 1400, and hinge ends (not illustrated) that are hinged to the first bending end 1253 and the second bending end 1255 are provided on both sides of the connection main body 1510 to protrude therefrom.

The connection end 1520 is provided at one end of the connection main body 1510 to protrude outwards, and the connection end 1520 is located at a lower end of the supply guide rail 1220 in which the release hole 1217*a* is formed when the safe mounting guide portion 1400 rotates upwards to transport a golf ball released to the release hole 1217*a* to one surface of the safe mounting guide portion 1400.

The other end of the connection body 1510 is provided with a hitting protrusion 1530, and the hitting protrusion 1530 serves to move a golf ball to the release hole 1217*a* by hitting a lower portion of the golf ball safely mounted and stopped on the stop hole 1220*a* on the supply guide rail 1220 when the safe mounting guide portion 1400 rotates.

A ball sensing portion 1600 is provided under the rubber tee 1100, one end of the ball sensing portion 1600 is in close contact with the rubber tee 1100, and the other end thereof comes selectively into close contact with the hitting protrusion 1530 of the ball hitting portion 1500. The ball sensing portion 1600 selectively comes into close contact with the hitting protrusion 1530 of the ball hitting portion 1500 while rotating depending on whether or not a golf ball is safely mounted on the rubber tee 1100 to serve to rotate the ball hitting portion 1500 and the safe mounting guide portion 1400.

The ball sensing portion 1600 is covered so as not to be exposed to the outside by the protective cover portion 1700, and the through-hole 1722 through which the rubber tee 1100 passes is formed in the protective cover portion 1700.

The hitting protrusion 1530 includes a close contact groove 1532 which the other end of the ball sensing portion 1600 selectively comes into close contact with and a catching end 1534 to which the other end of the ball sensing portion 1600 is selectively locked, the other end of the ball sensing portion 1600 selectively comes into close contact with the close contact groove 1532, and the catching protrusion 1620 selectively locked to the catching end 1534 protrudes to one side surface.

If the ball sensing portion 1600 is rotated by a golf ball safely mounted on the rubber tee 1100, the catching protrusion 1620 provided in the other end of the ball sensing portion 1600 is inserted into the close contact groove 1532, and, while the catching end 1534 is caught on one side of the catching protrude 1620, the rotation of the ball hitting portion 1500 and the safe mounting guide portion 1400 is blocked.

It is preferable that the mounting protrusion 1610 is provided in the ball sensing portion 1600, which is hinged to a hinge fastening groove 1610*a* of the protective cover portion 1700, to protrude outwards, and the mounting protrusion 1610 is located at a central portion of the ball sensing portion 1600 to be biased toward one end in close contact with the rubber tee 1100.

Referring to FIGS. 1 and 5, the protective cover portion 1700 includes a support member 1710 and a sealing member 1720. The support member 1710 is provided with a hinge fastening groove 1610*a* which has an upper portion opened in a square shape and to which the mounting protrusion 1610 is hinged, and rotatably supports a lower portion of the ball sensing portion 1600. The sealing member 1720 serves to seal the opened upper portion of the support member 1710, the through-hole 1722 through which the rubber tee 1100 passes is formed, and an end of the sealing member 1720 is bent upwards to be in close contact with the rotation groove 1215 of the second main body 1250.

When the safe mounting guide portion 1400 and the ball hitting portion 1500 come into close contact with the front sides of the first main body 1210 and the second main body 1250, the safe mounting guide portion 1400 and the ball hitting portion 1500 are located to be upright in the insertion groove 1211 and the rotation groove 1251, one surface of the safe mounting guide portion 1400 and one surface of the ball hitting portion 1500 come into close contact with the insertion groove 1211 and the rotation groove 1251, the other surface of the ball hitting portion 1500 comes into close contact with a cut end of the sealing member 1720, and thus, the safe mounting guide portion 1400 and the ball hitting portion 1500 are located inside the insertion groove 1211 and the rotation groove 1251 when being upright.

An operation of the ball supply device 1000 according to an embodiment configured as described above will be described with reference to FIGS. 1 to 7 as follows.

First, if a plurality of golf balls are arranged on the loading movement plate 1300, the golf balls are supplied from the loading movement plate 1300 to the supply guide rail 1220. The golf balls supplied to the supply guide rail 1220 are sequentially moved to be safely mounted in the stop hole 1220*a* formed on the supply guide rail 1220. If a user rotates one end of the safe mounting guide portion 1400 in a direction of the rubber tee 1100 only once for the first time, the ball hitting portion 1500 rotates according to the rotation of the safe mounting guide portion 1400 to make the hitting protrusion 1530 hit the golf ball safely mounted in the stop hole 1220*a* to be detached from the stop hole 1220*a*.

The golf ball detached from the stop hole 1220*a* is caught by the stopper catching plate 1235 of the ball stopper member 1230 and stops on the guide rail 1220 adjacent to the release hole 1217*a*.

In this way, one end of the safe mounting guide portion 1400 rotated downwards in the direction of the rubber tee 1100 by the user is returned to the rotation original location upwards again by a weight of the ball hitting portion 1500, and at this time, catching of the golf ball is released while the stopper catching plate 1235 is pushed and rotated by the catching hitting stand 1420 of the safe mounting guide portion 1400. Then, the golf ball is moved back to the release hole 1217*a* by the supply guide rail 1220, safe the safe mounting guide portion 1400 is pushed again and one end thereof is rotated downwards, and thus, the golf ball is guided to move to the rubber tee 110. Thereafter, the golf ball guided by the safe mounting guide portion 1400 is safely mounted on the rubber tee 110 through the passage hole 1440.

The golf ball is safely mounted on the rubber tee 1100 through the passage hole 1440 and at the same time, the golf ball is detached from an upper portion of the stop hole 1220*a* by hitting of the ball hitting portion 1500. Thereafter, while one end of the safe mounting guide portion 1400 rotates upwards again, a catching state of the golf ball caught in the stopper catching plate 1235 of the ball stopper member 1230 is released by the catching hitting stand 1420, and the golf ball of which the catching state is released is located in a stopped state on the release hole 1217*a* in a state where the golf ball is caught on the safe mounting guide portion 1400.

At this time, a catching protrusion 1620 provided in the other end of the ball sensing portion 1600 is inserted into the insertion groove 1532 formed in the hitting protrusion 1530 of the ball hitting portion 1500 in a state where the golf ball is disposed in the release hole 1217*a* 1532), the catching end 1534 of the hitting protrusion 1530 is caught on one surface of the catching protrusion 1620, and thereby, one end of the safe mounting guide portion 1400 does not rotate downwards. That is, as illustrated in FIG. 5, in a case where the golf ball is located on the rubber tee 1100, while one end of the ball sensing portion 1600 is pressed downwards by a weight of the golf ball, and the other end rotates upwards. Then, the catching protrusion 1620 provided in the other end of the ball sensing portion 1600 is inserted into the close contact groove 1532 of the ball hitting portion 1500, and while the catching end 1532 of the ball hitting portion 1500 is caught by the catching protrusion 1620, the safe mounting guide portion 1400 and the ball hitting portion 1500 are maintained in a fixed state without being rotated.

Thereafter, if the user hits the golf ball on the rubber tee 1100 thereby releasing a pressing state with respect to one end of the ball sensing portion 1600, and if one end of the ball sensing portion 1600 rotates again and moves upwards to an original location as illustrated in FIG. 6, the catching protrusion 1620 formed in the other end of the ball sensing portion 1600 is detached from the close contact groove 1532, and thereby, a catching state of the catching end 1534 and the catching protrusion 1620) is released.

As described above, if the catching state of the ball sensing portion 1600 and the ball hitting portion 1500 is released, the safe mounting guide portion 1400 is pushed by the golf ball disposed on the release hole 1217*a*, one end thereof rotates downwards, and thereby, the golf ball is moved in the direction of the rubber tee 1100 and the golf ball is safely mounted again on the rubber tee 110 through the through-hole 1440. Thereafter, an operation performed again to return the safe mounting guide portion 1400 and to detach the golf ball from an upper portion of the stop hole 1220*a* by the ball hitting portion 1500, and a catching fixing state of the ball sensing portion 1600 for the ball hitting portion 1500 is made.

Therefore, after the golf balls sequentially moved through the supply guide rail are detached from the upper portion of the stop hole by the ball hitting portion interlocking with the operation of the safe mounting guide portion in a state where the golf balls are safely mounted in the stop hole, the golf balls are safely mounted on the rubber tee through the safe mounting guide portion, and thus, elements that are organically connected to electric energy and a motor may be excluded, and while reducing failures, the golf balls are automatically and simply supplied onto the rubber tee without noise, resulting in reduction of a maintenance cost.

Although the present invention is described with reference to the embodiments illustrated in the drawings, these are merely examples, and those skilled in the art will understand that various modifications and equivalent other embodiments are possible therefrom. Therefore, the true technical protection scope of the present invention should be determined by the technical idea of the appended claims.

SIGNS LIST

| | | | |
|---|---|---|---|
| 1000: | ball supply device | 1100: | rubber tee |
| 1200: | main body | 1210: | first main body |
| 1250: | second main body | 1300: | loading movement plate |
| 1400: | safe mounting guide portion | 1500: | ball hitting portion |
| 1600: | ball sensing portion | 1700: | protective cover portion |

What is claimed is:

1. A ball supply device comprising:

a rubber tee on which each of a plurality of golf balls is safely mounted;

a main body which is spaced apart from the rubber tee and in which a plurality of golf balls to be safely mounted on the rubber tee are contained and a supply guide rail for guiding movement of the plurality of golf balls are provided inside the main body in a multi-bent shape such that the plurality of contained golf balls are sequentially released to a release hole formed on a front side, the main body comprising a first main body having a box shape with an open upper portion, and a second main body that supports a lower portion of the first main body;

a loading movement plate that is provided in an upper portion of the main body to partially seal the upper portion of the main body and has a shape inclined downwards such that the plurality of golf balls to be supplied to the upper portion are supplied to one side of the supply guide rail by gravity;

a safe mounting guide portion that rotates on the front side of the main body and guides the plurality of golf balls released to the release hole to the rubber tee so as to be safely mounted on the rubber tee;

a ball hitting portion that is rotatably provided on the front side of the main body to be rotated by the each golf ball supplied to the safe mounting guide portion, has one end connected to the safe mounting guide portion, and has the other end provided with a hitting protrusion for hitting a lower portion of the each golf ball to move the each stopped golf ball on the supply guide rail;

a ball sensing portion that has one end located on the lower portion of the rubber tee, has the other end selectively coming into close contact with the hitting protrusion, and rotates the ball hitting portion and the safe mounting guide portion by selectively coming into close contact with the ball hitting portion while rotating depending on the presence or absence of the each golf ball on the rubber tee; and a protective cover portion that surrounds the ball sensing portion so as not to be exposed to the outside and has a through-hole through which the rubber tee passes, wherein a stop hole in which the each golf ball is inserted and safely mounted to maintain a stopped state before being released to the release hole located on a front side of the main body is formed on the supply guide rail, wherein the stop hole is located adjacent to the release hole, wherein the supply guide rail having the multi-bent shape which is inclined downwards includes:

a first guide rail that is provided on one side of the first main body to sequentially move downwards golf balls supplied from the loading movement plate;

a second guide rail that is provided on a rear side of the first main body and is vertically connected to the first guide rail to sequentially move golf balls supplied through the first guide rail;

a third guide rail that is provided on the other side of the first main body and is vertically connected to the second guide rail to move a golf ball supplied through the second guide rail;

a fourth guide rail that is provided in one end on a front side of the first main body and is vertically connected to the third guide rail to move a golf ball supplied through the third guide rail;

a fifth guide rail that is vertically connected to the fourth guide rail to move a golf ball supplied through the fourth guide rail to an inside of the first main body;

a sixth guide rail that is vertically connected to the fifth guide rail to move a golf ball supplied through the fifth guide rail in a direction in which the first guide rail is located; and a seventh guide rail that is vertically connected to the sixth guide rail to move a golf ball supplied through the sixth guide rail to a release hole located on the front side of the first main body, wherein a length of the supply guide rail is sequentially reduced from the second guide rail to the sixth guide rail, wherein the stop hole is located in a portion where the sixth guide rail and the seventh guide rail are vertically connected so that the each golf ball provided to the stop hole is from a side direction along the sixth guide rail, wherein the supply guide rail has the multi-bent shape to include the first, second, third, fourth, fifth, sixth, and seventh guide rails so that loads of the plurality of golf balls moving downwards through the supply guide rail are dispersed and reduced at each of the first, second, third, fourth, fifth, sixth, and seventh guide rails.

2. The ball supply device of claim 1, wherein an insertion groove is formed on the front side of the first main body, and a rotation groove in which the ball hitting portion rotates is formed on a front side of the second main body, and wherein the safe mounting guide portion and the ball hitting portion are located to be upright within the insertion groove and the rotation groove when coming into close contact with the front side of the main body.

3. The ball supply device of claim 2, wherein the insertion groove is formed by a first insertion bending end and a second insertion bending end spaced apart from the front side of the first main body, and an insertion connection end connecting the first insertion bending end and the second insertion bending end which are spaced apart from each other, and wherein the release hole through which the golf ball moved to the supply guide rail is released outside the main body is formed in the insertion connection end.

4. The ball supply device of claim 3, wherein the rotation groove is connected to the insertion groove, wherein the rotation groove is formed by a first rotation bending end and a second rotation bending end which are spaced apart from the front side of the second main body, and a rotation connection end connecting the first rotation bending end and the second rotation bending end which are spaced apart from each other, and wherein a first mounting hole and a second mounting hole in which the ball hitting portion is rotatably mounted are formed in the first rotation bending end and the second rotation bending end.

5. The ball supply device of claim 3, wherein an upper portion of the release hole of the first main body is provided with a ball stopper member for blocking release of the golf ball to be released to the release hole through the supply guide rail and for releasing the blocking when the safe mounting guide portion comes into close contact with the insertion groove, and wherein the ball stopper member includes a stopper body configured by an upper support and a lower catching stand which are spaced apart from each other in a vertical direction and are coupled to protrude to an inside of the main body, and a stopper catching plate that has an upper end to be rotatably hinged to the upper support and a lower end to span the lower catching stand.

6. The ball supply device of claim 5, wherein the safe mounting guide portion has a rod shape, a catching hitting stand for rotating the stopper catching plate when the safe mounting guide portion rotates is mounted on one surface thereof to protrude, and a passage hole through which the golf ball passes is formed in one end of the safe mounting guide portion so as to pass through the safe mounting guide portion.

7. The ball supply device of claim 3, wherein the ball hitting portion includes:

a connection main body that has one end connected to the safe mounting guide portion and has a protruding hinge end hinged to the first and second rotation bending ends; and a connection end that protrudes outwards from one end of the connection main body and is located at a lower portion of an end of the supply guide rail when the safe mounting guide portion rotates upwards, wherein the hitting protrusion that is provided at the other end of the connection main body and hits the lower portion of the golf ball in the stopped state on the supply guide rail when the safe mounting guide portion rotates downwards.

8. The ball supply device of claim 7, wherein the hitting protrusion is provided with a close contact groove with which one end of the ball sensing portion is in close contact and a catching end on which the one end of the ball sensing portion is caught, and wherein a catching protrusion that is in close contact with the close contact groove and is caught on the catching end is provided in the other end of the ball sensing portion so as to protrude.

9. The ball supply device of claim 8, wherein a mounting protrusion hinged to a hinge fastening groove of the protective cover portion is provided in the ball sensing portion so as to protrude outwards, and wherein the mounting protrusion is biased toward one end in close contact with the rubber tee.

10. The ball supply device of claim 9, wherein the protective cover portion includes a supporting member that has a quadrangular shape with an open upper portion, includes the hinge fastening groove hinged to the mounting protrusion, and rotatably supports a lower portion of the ball sensing portion, and includes a sealing member which seals the open upper portion of the support member and in which a through-hole through which the rubber tee passes, and wherein an end of the sealing member is bent upwards and is in close contact with the rotation groove.

* * * * *